US008985412B2

(12) United States Patent
Rorick et al.

(10) Patent No.: US 8,985,412 B2
(45) Date of Patent: Mar. 24, 2015

(54) QUICK DRAW GUN HOLSTER

(75) Inventors: Steven Rorick, Fountain Valley, CA (US); John W. Matthews, Newport Beach, CA (US)

(73) Assignee: SureFire, LLC, Fountain Valley, CA (US)

( * ) Notice: Subject to any disclaimer, the term of this patent is extended or adjusted under 35 U.S.C. 154(b) by 225 days.

(21) Appl. No.: 13/470,063

(22) Filed: May 11, 2012

(65) Prior Publication Data

US 2013/0299543 A1 Nov. 14, 2013

(51) Int. Cl.
*F41C 33/04* (2006.01)
*F41C 33/02* (2006.01)

(52) U.S. Cl.
CPC ..... *F41C 33/0263* (2013.01); *F41C 33/0272* (2013.01)
USPC ..... 224/243; 224/245

(58) Field of Classification Search
CPC .. F41C 33/02; F41C 33/0236; F41C 33/0245; F41C 33/0254; F41G 1/35
USPC ..... 224/244, 238, 191–198, 912; D3/222; 362/110–114; 42/146, 114, 123, 132
See application file for complete search history.

(56) References Cited

U.S. PATENT DOCUMENTS

| | | | | |
|---|---|---|---|---|
| 2,336,718 | A | 12/1943 | Davis | |
| 3,550,822 | A | 12/1970 | Lloyd | |
| 4,713,889 | A | 12/1987 | Santiago | |
| 4,912,867 | A | 4/1990 | Dukes, Jr. | |
| 6,112,962 | A | 9/2000 | Matthews | |
| 6,267,279 | B1 * | 7/2001 | Matthews | 224/243 |
| 7,395,627 | B2 | 7/2008 | La France et al. | |
| 8,215,525 | B2 | 7/2012 | Rassias | |
| 8,602,276 | B2 * | 12/2013 | Tyybakinoja | 224/244 |
| 2005/0024807 | A1 | 2/2005 | Cerovic et al. | |
| 2005/0224537 | A1 | 10/2005 | Rassias | |
| 2006/0026886 | A1 | 2/2006 | Doukas | |
| 2006/0157520 | A1 | 7/2006 | Clifton, Jr. | |
| 2006/0226185 | A1 * | 10/2006 | Har-Shen | 224/244 |
| 2008/0110947 | A1 | 5/2008 | Pikielny | |
| 2008/0121670 | A1 | 5/2008 | Buress | |
| 2011/0011904 | A1 | 1/2011 | Schultz et al. | |
| 2012/0097718 | A1 * | 4/2012 | Baumann et al. | 224/193 |

FOREIGN PATENT DOCUMENTS

| | | |
|---|---|---|
| DE | 10 2007 049 954 | 4/2009 |
| FR | 2 659 430 | 9/1991 |
| WO | WO 95/13515 | 5/1995 |
| WO | WO 98/40686 | 9/1998 |
| WO | WO 2009/064326 | 5/2009 |

* cited by examiner

*Primary Examiner* — Justin Larson
*Assistant Examiner* — Phillip Schmidt
(74) *Attorney, Agent, or Firm* — Haynes and Boone, LLP

(57) ABSTRACT

A holster for a handgun includes an adapter configured to be coupled to a front end portion of the gun, a housing having an internal cavity defined by a pair of parallel side walls held in spaced opposition to each other by a spacer wall, complementary sliding features respectively disposed on the adapter and interior surfaces of the side walls and engagable with each other so as to enable the adapter to be slidably received in the cavity of the housing, complementary latching features respectively disposed on the adapter and interior surfaces of the side walls and engagable with each other so as to prevent the withdrawal of the adapter from the cavity of the housing until selectably released therefrom, and a mechanism for selectably releasing the engagement of the latching features with each other so as to enable the withdrawal of the adapter from the cavity of the housing.

21 Claims, 12 Drawing Sheets

QUICK DRAW GUN HOLSTER

BACKGROUND

1. Technical Field

This disclosure relates to firearms in general, and in particular, to embodiments of a quick draw holster for a handgun that enables the gun to be carried securely on the person of a user during strenuous physical activities, yet which enables the gun to be drawn for use quickly, safely, and reliably.

2. Related Art

Holsters for carrying a handgun on the person of a wearer are widely known in the field of firearms and have been in use for many years. Some holsters rely on friction to secure the handgun in the holster, but this arrangement might not be suitable during certain movements of the wearer that could cause the frictional grip of the holster on the gun to be broken.

Other holsters rely on an "over-center" design that incorporates one or more springs to secure the gun. This type of holster has the drawback that certain accelerations applied to the holster can act to compress the springs) and cause an unexpected release of the gun from the holster at a critical moment.

Additional holster designs have incorporated straps, flaps, hood enclosures, and the like, to secure the gun therein. However, unfastening these enclosures before drawing the gun can take an unacceptable amount of time in exigent circumstances, e.g., combat.

Also, in some instances, the handgun can be equipped with an accessory, such as a silencer, a light and/or a laser sighting device, in which case, the holster must be capable of accommodating such accessories, yet still enable the gun to be removed from the holster with a quick and short draw, preferably with a length that is shorter than the overall length of the gun and accessory combination.

A need therefore exists for handgun holsters that can accommodate a gun with or without accessories mounted thereon and enable it to be carried securely on the person of a wearer, yet which also enable the gun to be drawn from the holster for use in a quick, safe, and reliable manner.

SUMMARY

In accordance with the present disclosure, novel quick draw hand gun holsters are described, together with methods for using them, that enable the guns to mount accessories, such as silencers, lights and/or lasers, and to be carried securely on the person of a user during strenuous physical activities, yet which enable them to be drawn for use quickly, safely and reliably.

In one example embodiment, a gun holster comprises a generally U-shaped adapter configured to be coupled to a lower surface of a front end portion of the gun's receiver. The adapter has opposing side walls, each having one of a pair of forwardly extending longitudinal lands disposed thereon, each land having a notch disposed in a lateral edge thereof.

The example holster further includes a generally ┌-shaped housing having a pair of side walls held in spaced opposition by a spacer wall coupled between corresponding edges thereof. Each side wall has an interior surface containing one of a pair of forwardly extending longitudinal grooves disposed therein, each groove being configured to receive a corresponding one of the lands of the adapter in a slide-in engagement.

A latching mechanism is configured to engage at least one of the notches in the lands of the adapter so as to prevent the withdrawal of the adapter from the housing until it is selectably released therefrom. In addition, a release mechanism is configured to selectably release the engagement of the latching mechanism with the at least one notch so as to enable the withdrawal of the adapter from the housing.

In accordance with another embodiment, a method for using the example holster comprises coupling the adapter to the gun, and inserting the gun and adapter into the housing such that the lands of the adapter are slidably received in corresponding ones of the longitudinal grooves of the housing, and the latching mechanism is engaged with the at least one notch.

The scope of this invention is defined by the claims appended hereafter, which are incorporated into this section by reference. A more complete understanding of embodiments of the present invention will be afforded to those skilled in the art, as well as a realization of additional advantages thereof, by a consideration of the following detailed description of one or more example embodiments. Reference will be made to the appended sheets of drawings that will first be described briefly, and within which like reference numerals are used to identify like elements illustrated in one or more of the figures thereof.

DETAILED DESCRIPTION

Figure 1B:
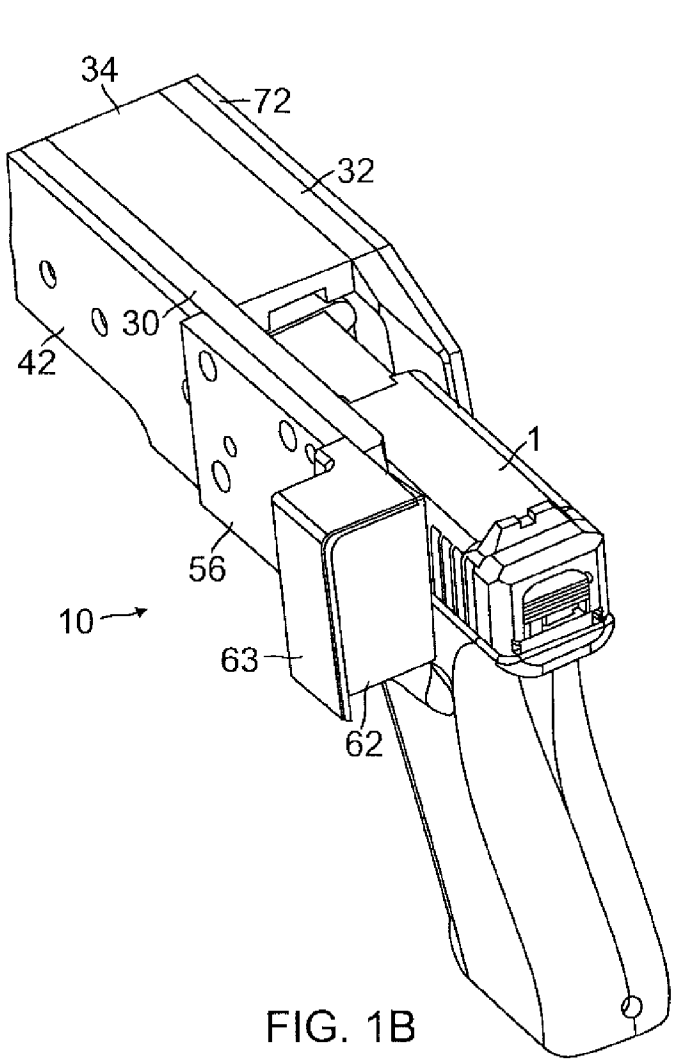
FIG. 1B is an upper, left side, rear perspective view of the holster and gun.
Figure 1A:
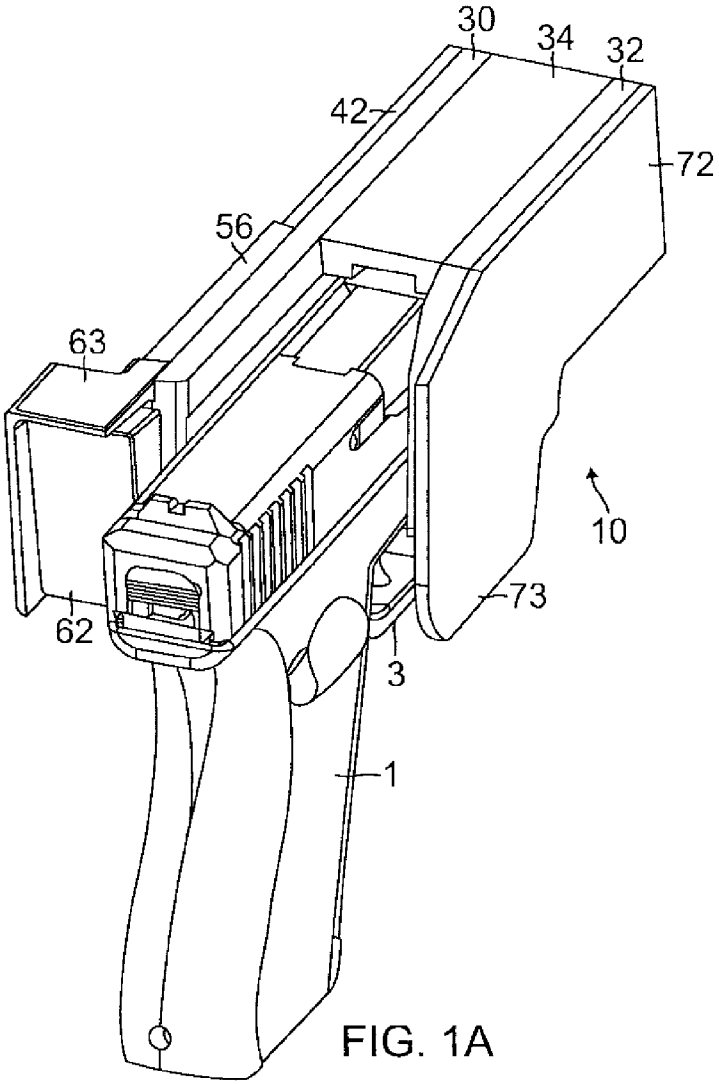
FIG. 1A is an upper, right side, rear perspective view of an example embodiment of a quick draw holster and associated handgun in accordance with the present invention.
Figure 1C:
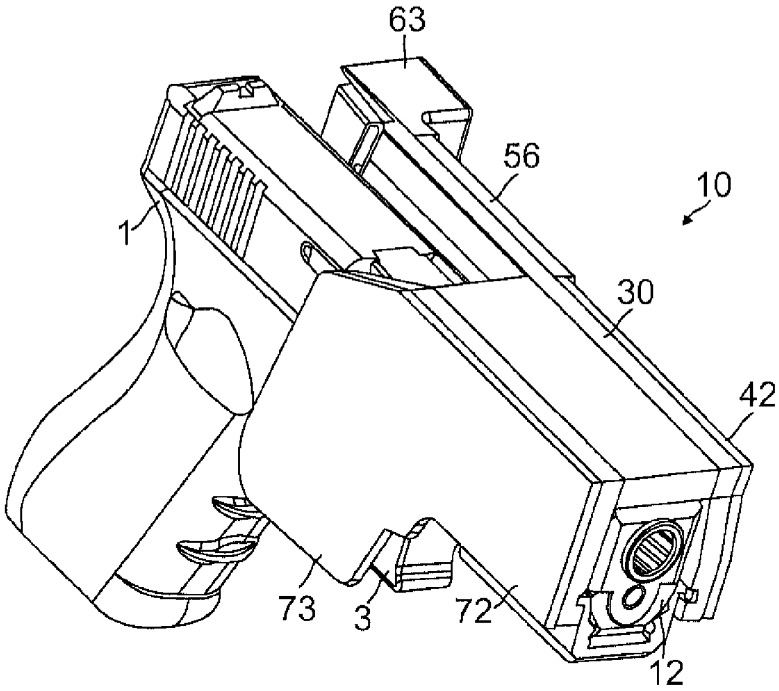
FIG. 1C is an upper, left side, front perspective view of the holster and gun.
Figure 1D:
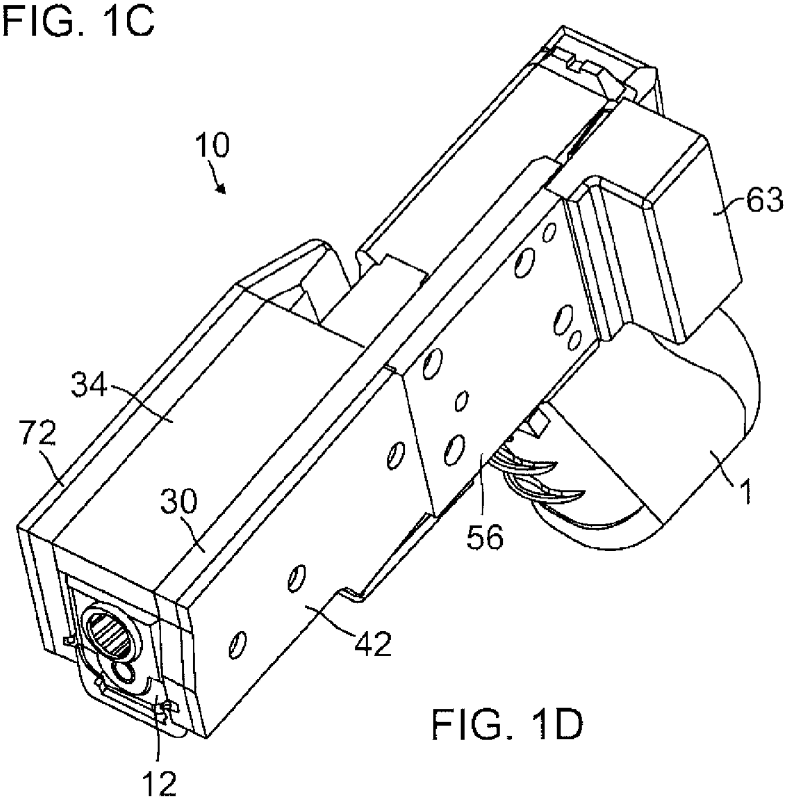
FIG. 1D is an upper, right side, front perspective view of the holster and gun.
Figure 2A:
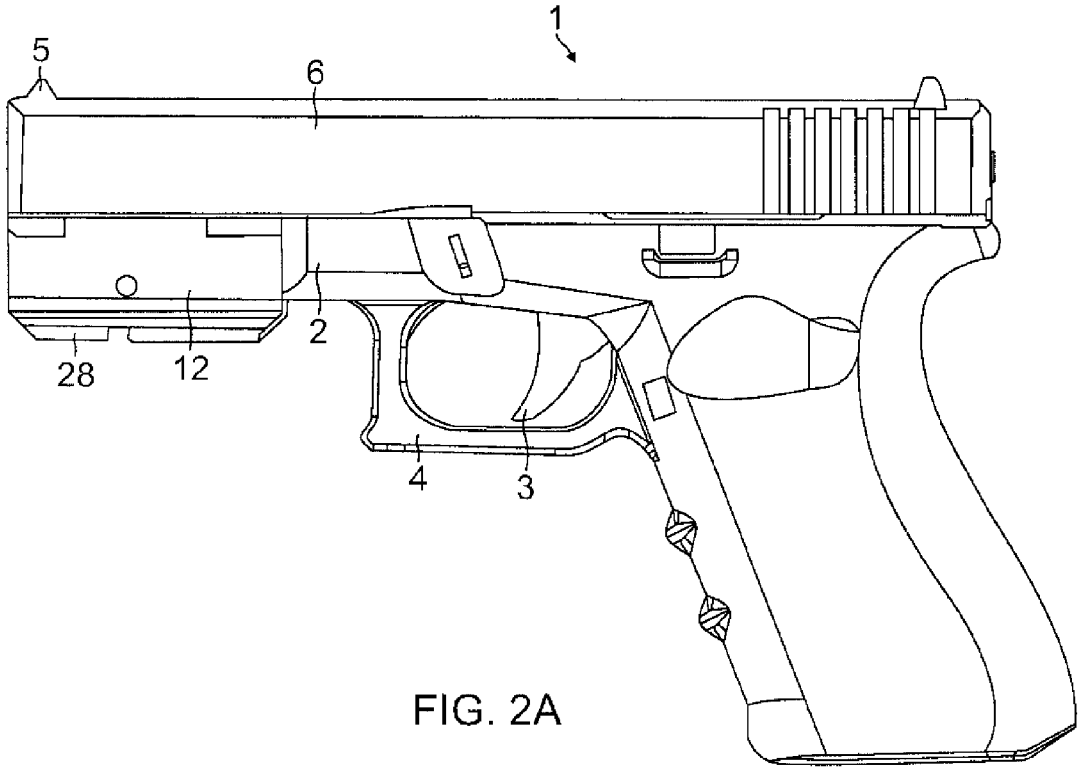
FIG. 2A is a left side elevation of an example embodiment of a holster adapter in accordance with the present invention, shown coupled to an associated handgun.
Figure 2B:
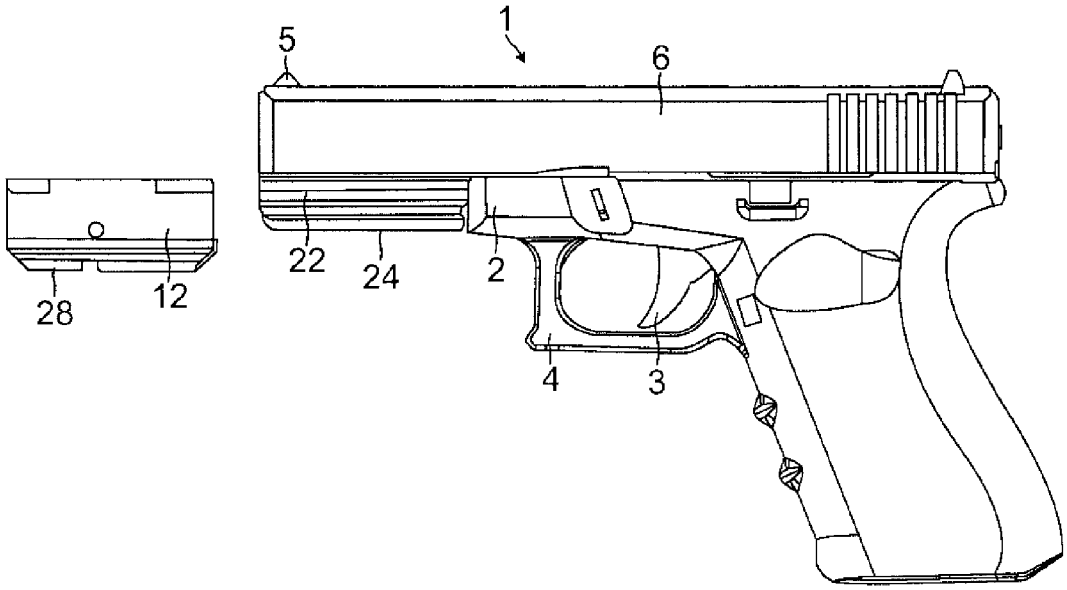
FIG. 2B is an exploded left side elevation view of the holster and adapter of FIG. 2A.
Figure 3A:
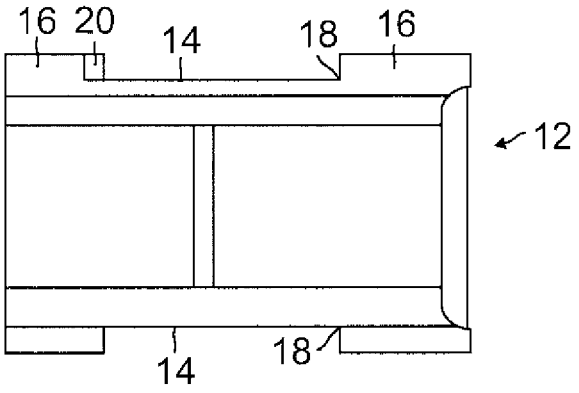
FIGS. 3A-3E are top plan, front end elevation, left side elevation, rear end elevation, and bottom plan views, respectively, of the example holster adapter of FIGS. 2A and 2B.
Figure 3B:
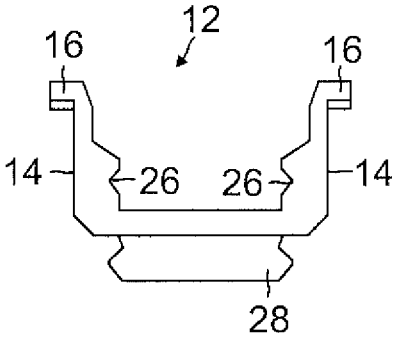
Figure 3C:
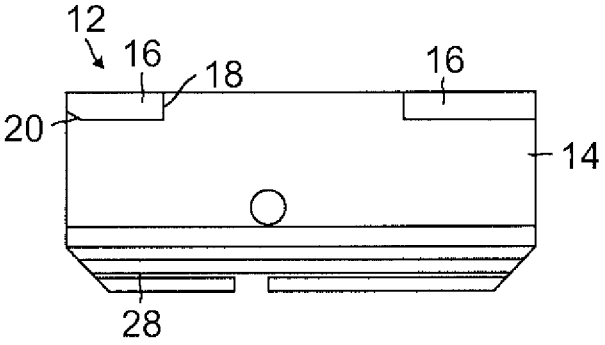
Figure 3D:
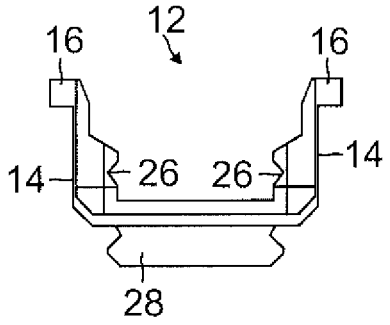
Figure 3E:
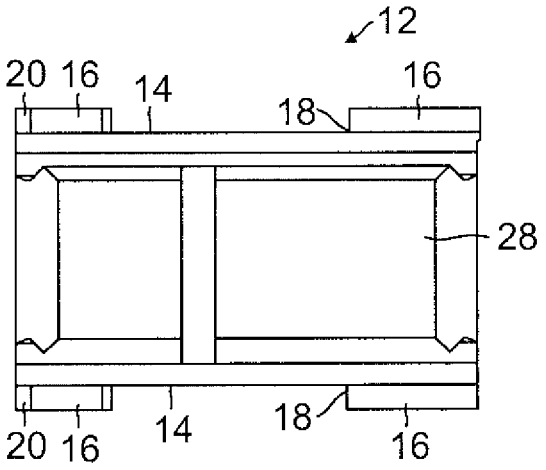

In accordance with the present invention, holsters for hand guns are provided that enable guns to be carried securely on the person of a wearer, yet which also enable the gun and accessories to be drawn from the holster for use in a quick, safe and reliable manner. The secure holstering of the gun and its quick release from the holster also accommodate accessories mounted on the gun, such as silencers, flashlights and/or laser targeting devices, The holsters are preferably chest mounted, more preferably in a concealed fashion, but can also be carried on a high or a low belt rig. The holsters of the present invention can be used on a wide variety of hand held guns, although their internal mechanisms remain substantially similar. To accommodate different handguns, the shape and size of the constituent parts can be easily varied during their manufacture. As an alternative to using discrete "billet" parts, the holster housing may be manufactured using a molding process.

An embodiment of a quick draw holster 10 in accordance with the present invention is illustrated in the perspective views of FIGS. 1A-1D, where it is shown carrying an associated handgun 1. In the particular embodiment illustrated, the associated gun 1 comprises, as an example, a Glock semi-automatic pistol. However, as will become clear in the following description, the holster 10 can easily be modified to accommodate a wide variety of other types of pistols, such as the Colt M1911 pistol, the H&K P7 and USP pistols, the Steyr M series pistols, the Smith & Wesson MP series pistols, and many others, as well.

As illustrated in, e.g., FIGS. 2A, 2B and 3A-3E, the holsters 10 of the present invention utilize a holster adapter 12 that serves as an interface between the holster 10 and the associated gun 1. Thus, no direct contact occurs between the holster 10 and the associated gun 1. Rather, the holster 10 holds, retains and ejects the gun 1 through the agency of the adaptor 12. As may be seen in FIGS. 2A, 2B and 3A-3E, the example adapter 12 illustrated, which is configured to couple the holster 10 to the Glock pistol discussed above, incorporates a generally U-shaped cross-section configured to be coupled to a lower surface of a front end portion of the gun's receiver 2. The adapter 12 has opposite side walls 14, each of which has one of a pair of forwardly extending longitudinal lands 16 disposed thereon. Each land 16 incorporates a notch 18 disposed in a lateral edge thereof that can be used as discussed below to retain the adapter 12, and hence the gun 1, in the holster 10. In some embodiments, the front and rear ends of the longitudinal lands 16 can incorporate ramp features 20 that can facilitate interaction with the retaining and/or ejector mechanisms described in more detail below.

As those of some skill in the art will appreciate, some handguns 1, such as the example Glock illustrated in the figures above, incorporate a pair of longitudinal grooves 22 (see FIG. 2B) on the lower surface of a front end portion of the gun's receiver 2 that defines a mounting rail 24 for mounting an accessory, such as lights or a laser sighting devices of a known type. As illustrated in the cross-sectional views of the adapter 12 in FIGS. 3B and 3D, the adapter 12 can utilize these features for coupling the adapter 12 to the gun 1 by incorporating complementary rail-receiving grooves 26 on the interior walls of the adapter 12, then reproduce the accessory mounting rail 24 of the gun 1 with a similar mounting rail 28 disposed on the lower surface of the adapter 12. In this manner, the functionality of the accessory mounting rail 24 on the gun 1 is preserved.

Figure 9:
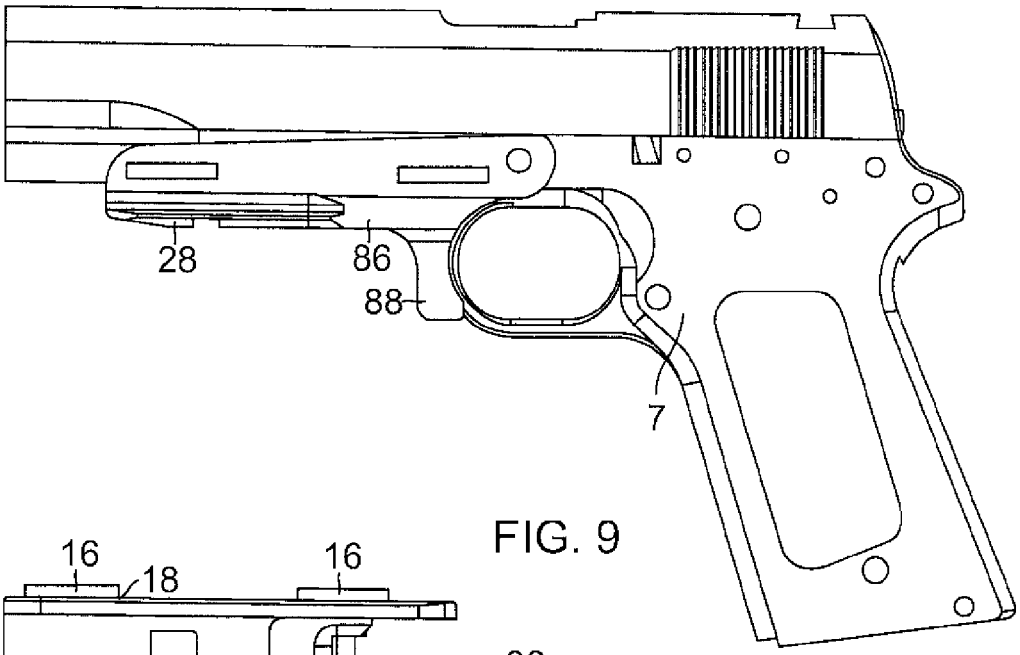
FIG. 9 is a left side elevation view of an alternative embodiment of a holster adapter in accordance with the present invention, shown coupled to another handgun.
Figure 10A:
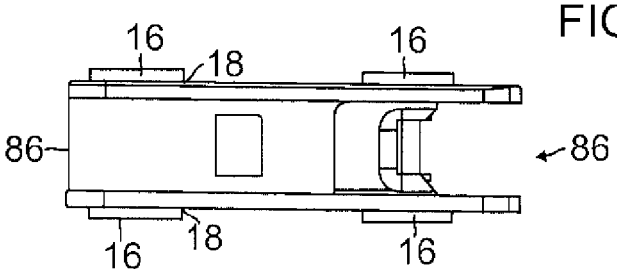
FIGS. 10A-10E are top plan, front end elevation, left side elevation, rear end elevation, and bottom plan views, respectively, of the alternative holster adapter of FIG. 9.
Figure 10B:
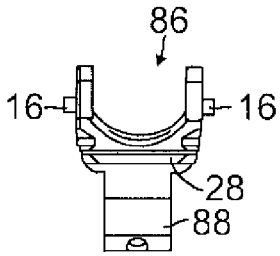
Figure 10C:
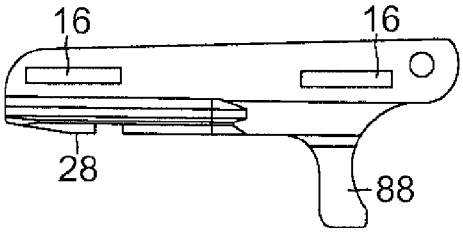
Figure 10D:
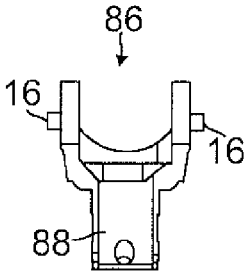
Figure 10E:
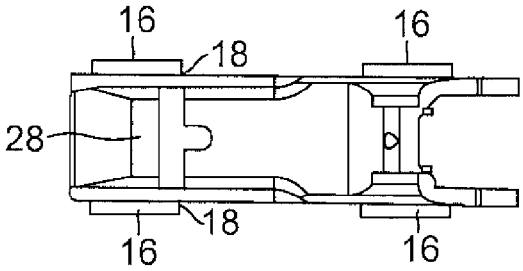

Indeed, as discussed below in connection with the alternative adapter 86 and gun 7 embodiment of FIG. 9, the holster adapters of the present invention can be used to provide an accessory mounting feature, such the mounting rail 28, on guns 7 of a type that do not ordinarily include an accessory mounting feature. Thus, in some embodiments, the holster adapter 12 can serve two purposes, viz., adapting the gun 1 to the holster 10, and providing the gun 1 with an accessory mounting feature.

Figure 4A:
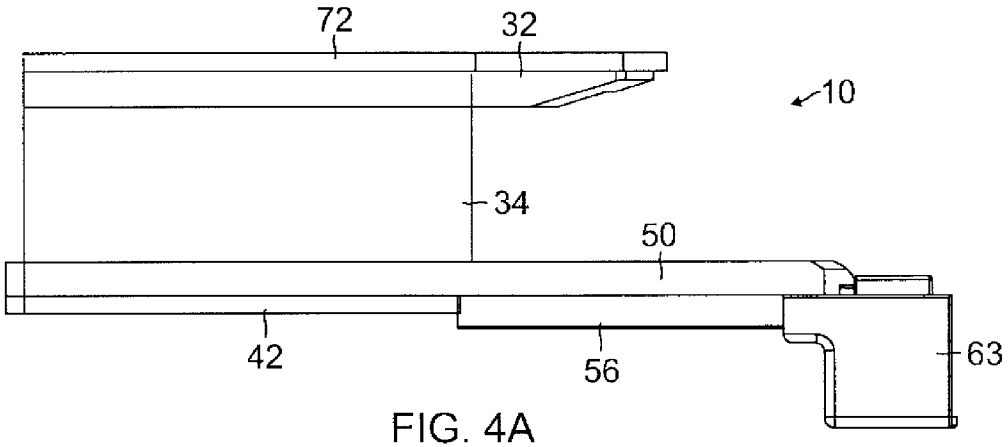
FIGS. 4A-4F are top plan, left side elevation, rear end elevation, right side elevation, bottom plan, and front end elevation views, respectively, of the example holster.
Figure 4B:
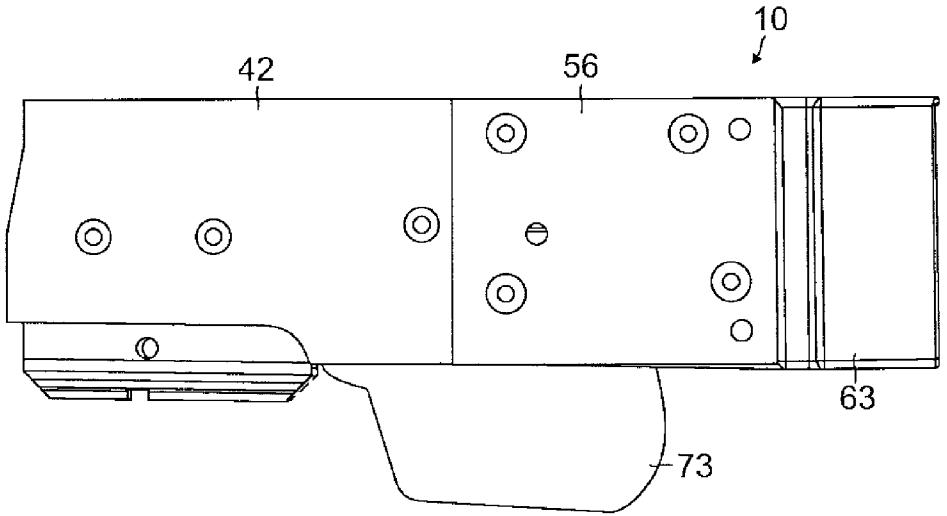
Figure 4C:
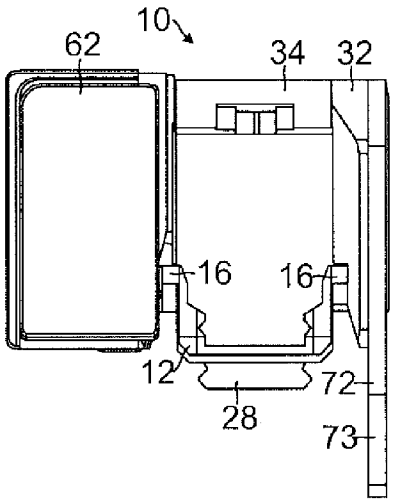
Figure 4F:
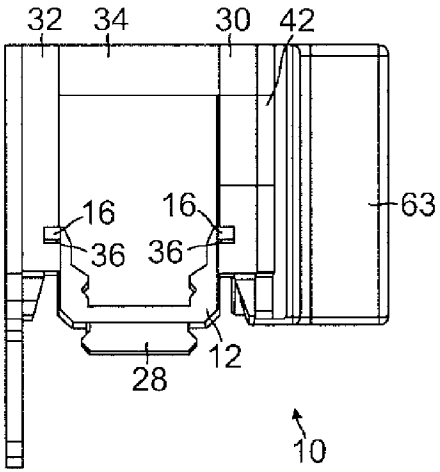
Figure 4D:
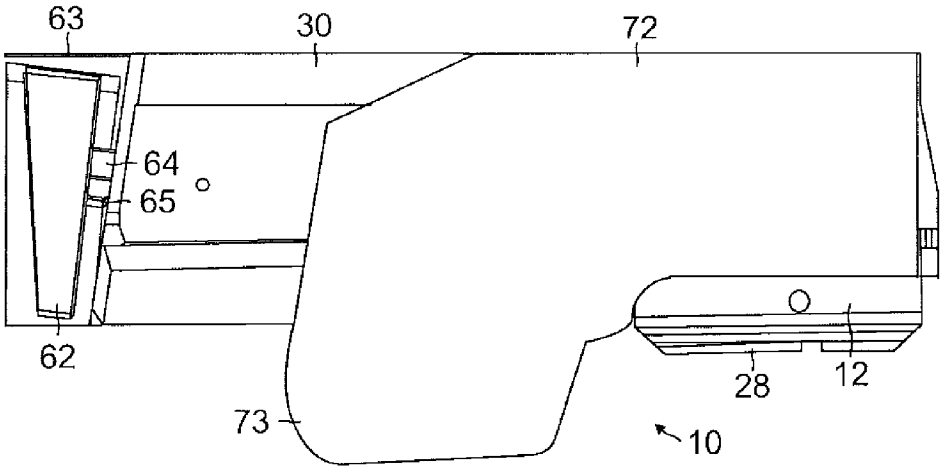
Figure 4E:
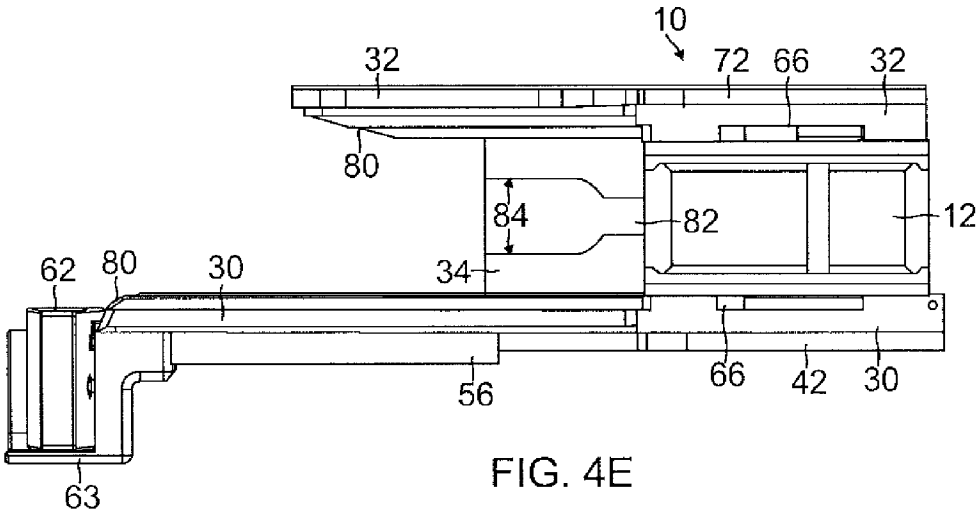
Figure 5:
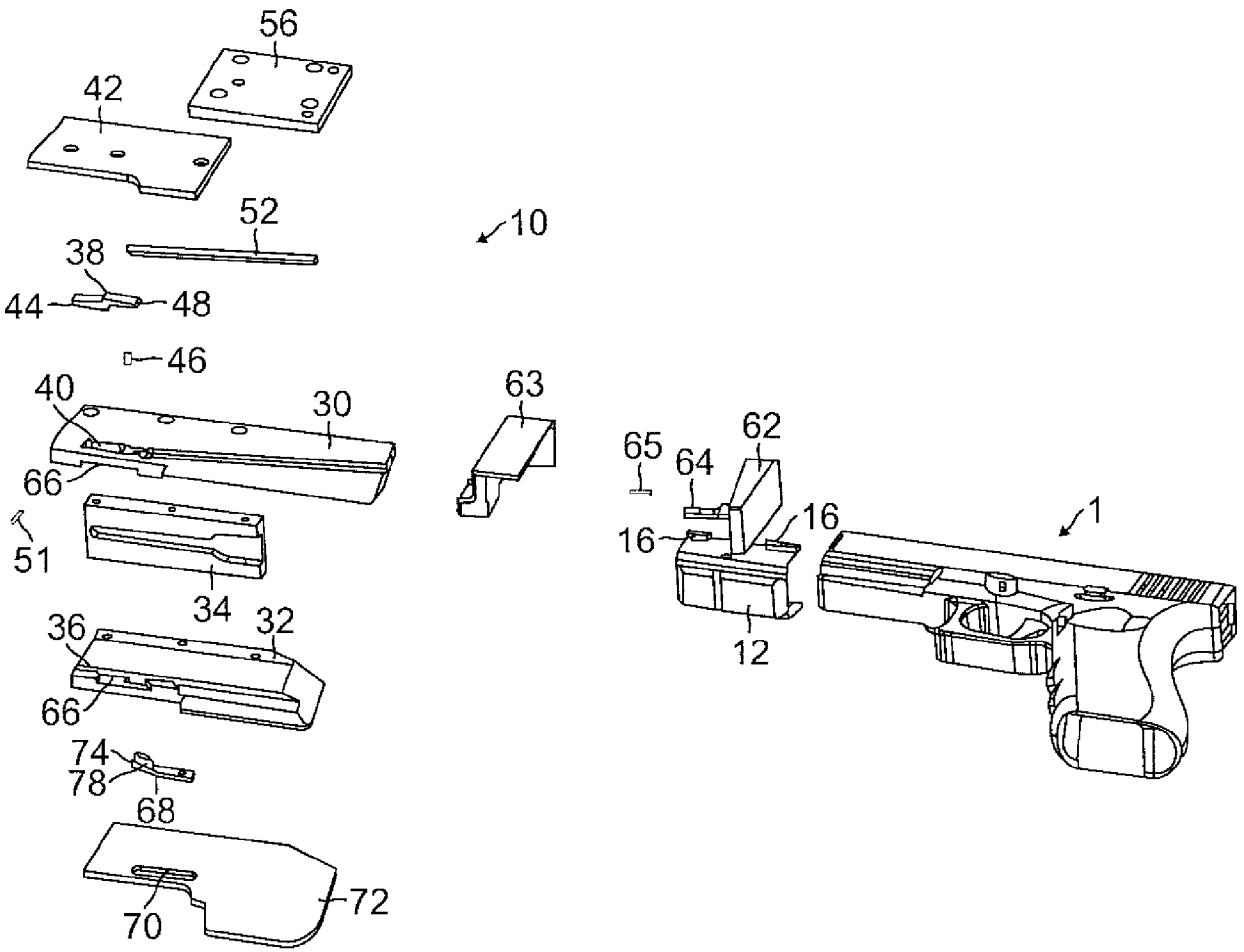
FIG. 5 is an exploded lower, left side, rear perspective view of the holster and associated gun, showing constituent parts of the holster.
Figure 6:
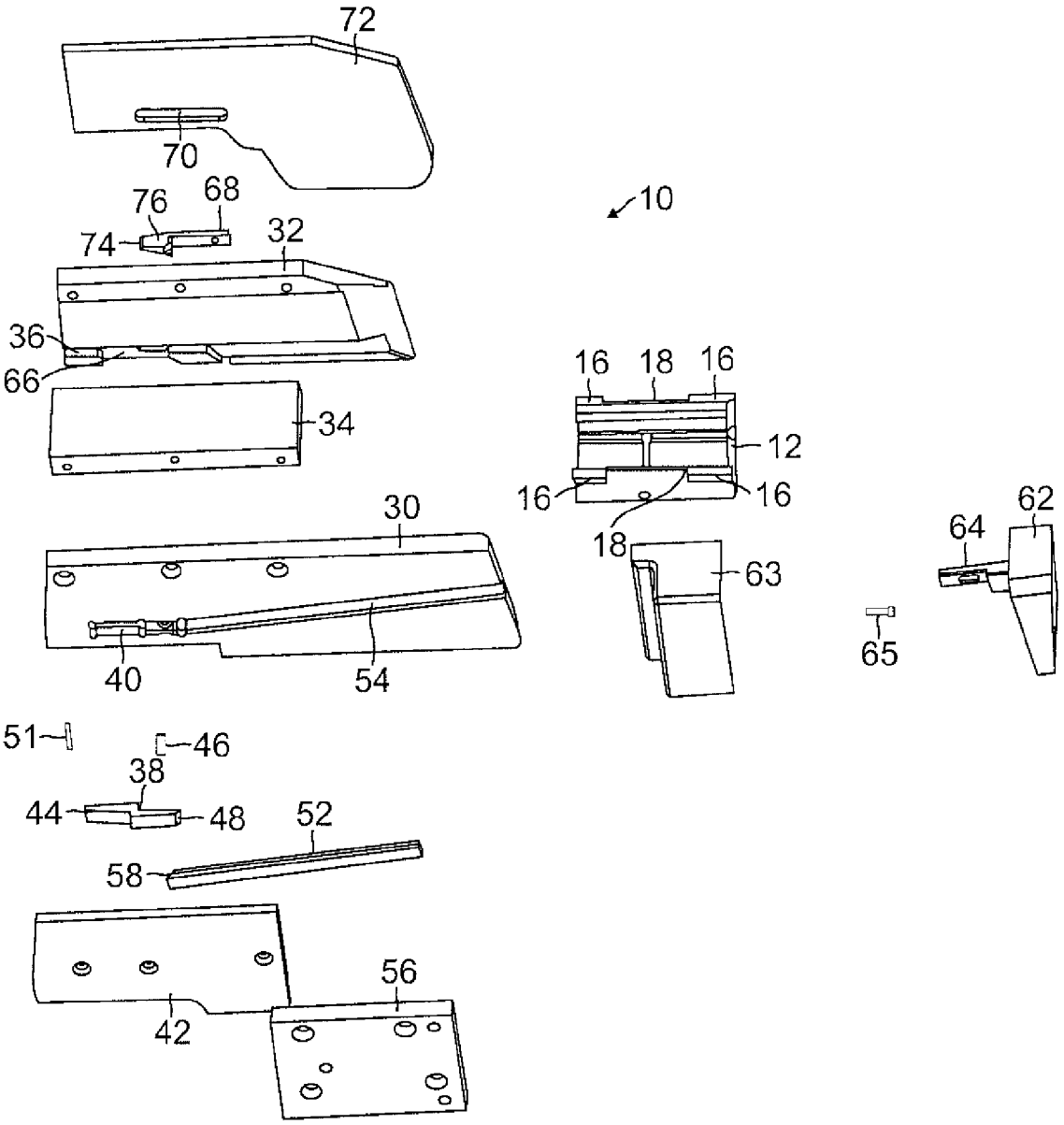
FIG. 6 is an exploded upper, left side perspective view of the holster, from which the associated gun has been omitted.
Figure 7:
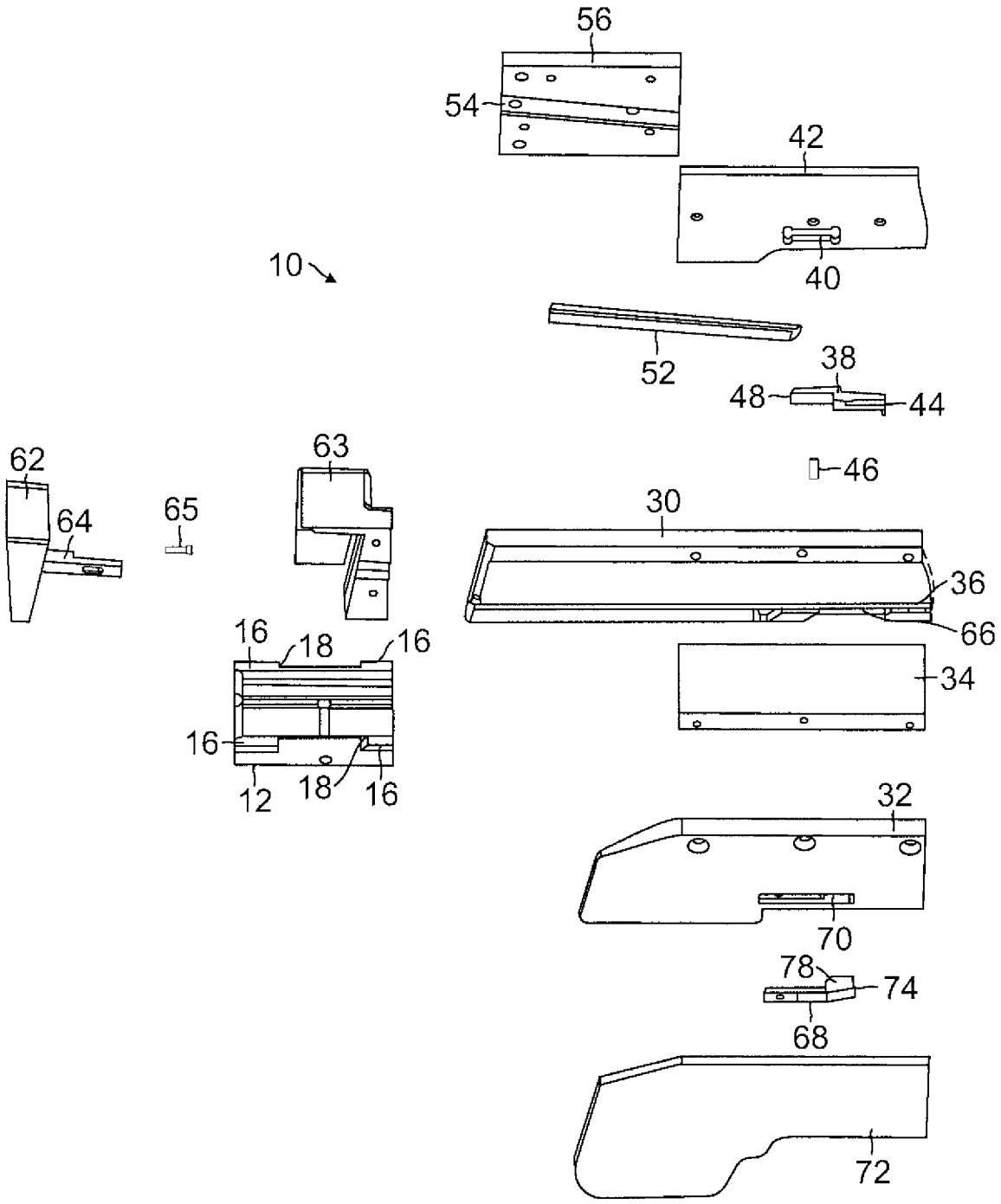
FIG. 7 is an exploded upper, right side perspective view of the holster.
Figure 11A:
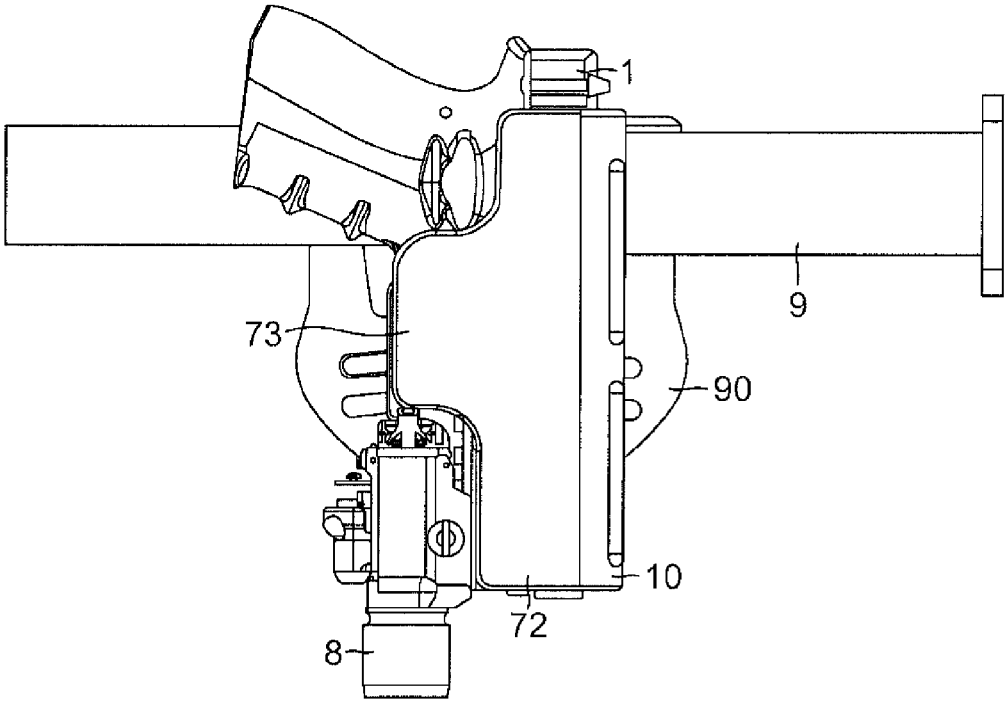
FIG. 11A is a right side elevation view of an example embodiment of a holster in accordance with the present invention, showing the holster coupled to the belt of a wearer and carrying an associated handgun having an accessory mounted thereon.
Figure 11B:
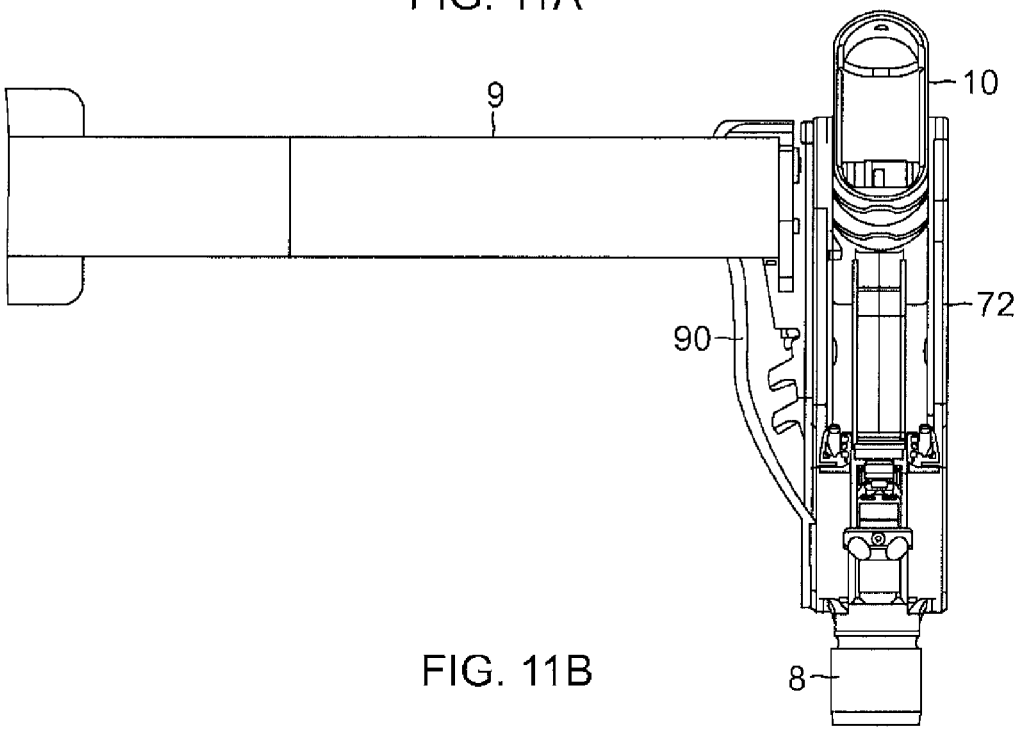
FIG. 11B is a rear end elevation view of the holster, gun and accessory of FIG. 11A.

Turning now to the example holster 10 itself, FIGS. 4A-4F illustrate the holster 10 in an assembled form, and the exploded views of FIGS. 5-7 illustrate its constituent parts and their relative arrangement. With reference to these figures, the example holster 10 can be seen to comprise a generally ⊓-shaped housing having a pair of side walls or plates 30 and 32 held in spaced opposition to each other by a top plate or spacer wall 34 coupled between corresponding upper edges thereof. It will be appreciated that elements 30, 32, and 34 comprise plates in a "billet" embodiment such that the plates would then be fastened, glued, or welded together to form the housing. In contrast, elements 30, 32, and 34 comprise walls in a molded housing embodiment. As used herein, the term "wall" will refer to either molded or billet embodiments. The remaining description will refer to these elements as "plates" but it will be appreciated that molded embodiments are within the scope of the disclosure. In that regard, holster 10 may comprise metal, polymer, or fiber components. For descriptive purposes, the side plate 30 is sometimes referred to herein as the "left" or "medial" side plate 30, as it is disposed closest to the medial plane of a wearer when the holster is worn on the wearer's hip, as illustrated in FIGS. 11A and 11B, whereas, the side plate 32 is sometimes referred to as the "right" or "distal" side plate 32.

As illustrated in, e.g., FIGS. 4F, and 5-7, each of the two side plate 30 and 32 has an interior surface containing one of a pair of forwardly extending longitudinal grooves 36 disposed therein, each of which is configured to receive a corresponding one of the longitudinal lands 16 of the adapter 12 in a slide-in engagement. Additionally, as discussed above, rather than rely on a simple but less reliable flap or "over-center" latching mechanism to retain the gun 1 in the holster 10, it is desirable to provide a more "positive" latching mechanism in the holster 10 that acts on the adapter 12 for that purpose, and consequently, it is also desirable to provide a convenient, reliable and quick-acting release mechanism for selectably releasing the gun 1 from the holster 10.

Figure 8:
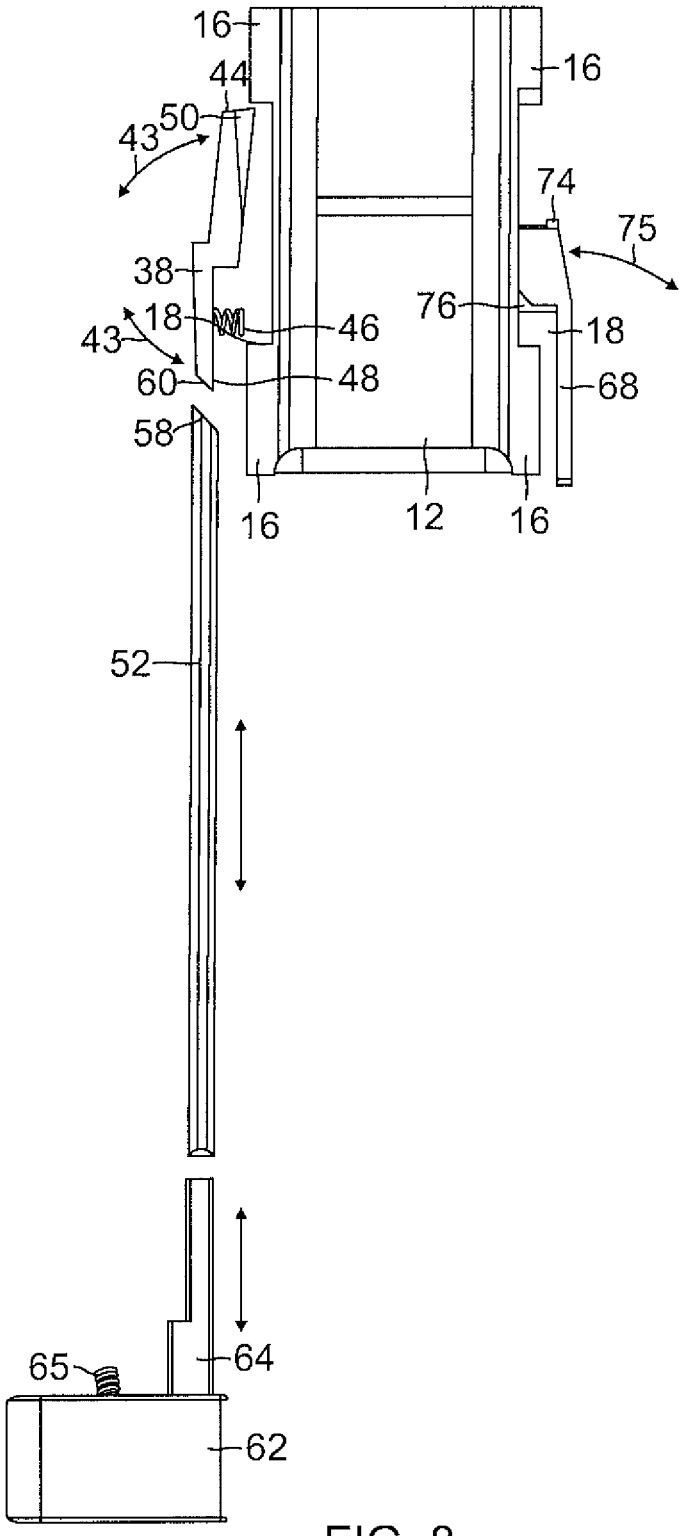
FIG. 8 is a top plan view of the example holster adapter, showing details of example latching, release and ejection mechanisms useable in association therewith.

FIG. 8 is a top plan view of the holster 10 in which all components of the holster 10, including the two side plates 30 and 32 and the top plate 34, have been omitted for purposes of illustrating the latching and release mechanisms. As illustrated in FIG. 8, in some embodiments, the latching mechanism can comprise an elongated pawl 38 that is pivotally disposed within a recess 40 in the medial or left side plate 30 of the housing and aligned with the longitudinal groove 36 therein. The pawl 38 can be captivated in the recess 40 by, e.g., a front-medial side cover plate 42 coupled to the left or medial side of the medial plate 30 (see, e.g., FIGS. 5-7) for pivotal movement in the direction indicated by the arrows 43.

The pawl 38 has a front end 44 that is resiliently biased, e.g., by a spring 46, into the adjacent longitudinal groove 36, an opposing rear end 48, and a ramp 50 disposed on a lateral surface thereof. The ramp 50 is configured to engage a front end of a corresponding one of the lands 16 of the adapter 12, and as a result, to pivot the front end 44 of the pawl 38 out of the adjacent longitudinal groove 36 when the corresponding land 16 is slid forwardly into the groove 36. In some embodiments, a stop mechanism, such as the roll pin 51 shown in FIGS. 5 and 6, can be included in the holster 10 housing to prevent the adapter 12 from sliding past a front end of the housing.

Thus, when the adapter 12 (and hence, the lands 16 and a gun 1 coupled to the adapter 12) are slid forwardly into the holster 10 such that the longitudinal lands 16 of the adaptor 12 slide into corresponding ones of the longitudinal grooves 36, a front end of the land 16 adjacent to the pawl 38 urges the front end 44 of the pawl 38 to the side, thereby allowing the lands 16 of the adapter 12 to proceed further into the longitudinal grooves 36 in the side plates 30 and 32, until the notch 18 in the lateral edge of the land 16 adjacent to the pawl 38 is positioned adjacent to the front end 44 of the pawl 38, at which point, the front end 44 of the pawl 38 pivots back into the adjacent longitudinal groove 36 so as engage the notch 18 in the land 16 of the adapter 12 and prevent the withdrawal of the adapter 12 (and hence, a gun 1 coupled to it) from the holster 10 until the latching mechanism is intentionally released with a release mechanism. Notch 18 and land 16 thus form a ratchet that engages pawl 38.

An example embodiment of such a release mechanism is also illustrated in FIG. 8. As shown in FIG. 8, the example release mechanism can comprise a push rod 52 that is slidably disposed in, e.g., a channel 54 defined between a medial wall of the medial side plate 30 and a rear-medial side cover plate 56 (see, e.g., FIGS. 6 and 7) for fore and aft movement behind the pawl 38. As illustrated in, e.g., FIG. 8, the push rod 52 has a front end with a chamfer 58 disposed thereon. The chamfer 58 is configured to pivot the front end 44 of the pawl 38 out of the adjacent longitudinal groove 36 in the direction of the arrow 43 when it is pushed into engagement with a complementary chamfer 60 disposed on the rear end 48 of the pawl 38. This causes the front end 44 of the pawl 38 to pivot out of engagement with the notch 18 in the adjacent land 16 of the adapter 12, thereby enabling the adapter 12 (and hence, a gun 1 coupled to it) to be withdrawn from the holster 10.

In the particular example embodiment illustrated in FIG. 8, a thumb actuated push button 62 is slidably disposed on the medial side plate 30 for fore and aft movement behind the push rod 52. The push button 62 has a forwardly protruding boss 64 with a front end disposed behind the push rod 52. The front end of the boss 64 is configured to engage a rear end of the push rod 52 and to urge the push rod 52 forward when the push button 62 is pressed by the user's thumb, thereby unlatching the adapter 12 for withdrawal from the holster 10. As illustrated in, e.g., FIGS. 5-8, in some embodiments, the thumb actuated push button 62 can be surrounded for protection against dirt or accidental actuation by a push button cover shroud 63 coupled to the side plate 30 and configured to cover at least two sides of the push button 62. A spring 65 disposed between the shroud 63 and the push button 62 can be used to bias the push button 62 in a rearward direction.

As discussed above, it is desirable for the holster 10 to provide for a very short "draw" of the gun 1 therefrom, and this is particularly so when an elongated accessory, such as a silencer or a laser is coupled to the muzzle or receiver 2 of the gun 1. In some embodiments of the present invention, this can be effected by an ejector mechanism that enables the adapter 12, and hence, a gun 1 coupled to it, to be ejected from the bottom of the holster 10 after a rearward (or upward, if the holster 10 is being worn on the wearer's hip) draw or pull of the gun 1 of only about 0.5 inch.

As illustrated in, e.g., FIGS. 5-8, in some embodiments, the "quick draw" ejector mechanism can comprise a slot 66 formed in the lower edge of each of the side plates 30 and 32 that extends between the lower edge of the plate and the longitudinal groove 36 therein. As illustrated in, e.g., FIG. 8, an elongated ejector cam 68 can be pivotally disposed within a recess 70 in one of the side plates, for example, in a recess 70 formed between a distal side surface of the distal side plate 32 and a distal side cover plate 72 disposed thereon, and held thereby in alignment with the adjacent longitudinal groove 36. The ejector cam 68 can have a front end 74 that is resiliently biased into the adjacent longitudinal groove 36. In some embodiments, this can be effected by a spring, as in the case of the latching pawl 38 discussed above. In another advantageous embodiment, the ejector cam 68 can be fabricated of a thermoplastic material having high stiffness, low friction and good dimensional stability, such as polyoxymethylene (e.g., DuPont Delrin) such that ejector cam 68 itself provides the resilience which enables it to be pushed out of the way as the gun is holstered.

In some embodiments, the distal side cover plate 72 can also be provided with a lower extension 73 configured to cover a trigger 3 and/or a trigger guard 4 of the gun 1 (see FIGS. 2A, 2B) when the gun 1 is disposed in the holster 10, as illustrated in FIGS. 11A and 11B. The extension 73 on the cover plate 72 can serve to prevent accidental contact with the trigger 3 of the gun 1 by the user when the gun 1 is being carried in the holster 10.

The front end 74 of the ejector cam 68 can include first and second ramps 76 and 78 respectively disposed on upper and lower surfaces thereof. The first ramp 76 can be configured to engage a front end of a corresponding one of the longitudinal lands 16 of the adapter 12 and to push the front end 74 of the ejector cam 68 laterally and out of the corresponding longitudinal groove 36 (in the direction of the arrow 75 in FIG. 8) when the corresponding land 16 is slid forwardly into the groove 36, thereby enabling the adapter 12 to bypass the ejector cam 68. The front end 74 of the cam 68 will then snaps back resiliently into the longitudinal groove 36 when the notch 18 of the corresponding land 16 is disposed adjacent to the front end 74 of the cam.

With respect to the ejection of the gun from the holster, as the adapter 12 and corresponding land 16 is then slid rearwardly in the corresponding longitudinal groove 36, the second ramp 78 on the lower surface of the front end 74 of the ejector cam 68 can be configured to engage a rear edge of the notch 18 in the lateral edge of the corresponding land 16 of the adapter 12, and thereby urge the adapter 12 (and hence, a gun 1 coupled to it) through the slots 66 at the lower edges of the side plates 30 and 32 and in a direction generally perpendicular to the longitudinal grooves 36 therein, i.e., through the bottom opening of the holster 10. In some embodiments, this ejection of the gun 1 can be effected by a rearward "draw" or "pull" of the gun 1 of only about 0.5 inch.

Advantageously, the adapter 12 and associated gun 1 can be inserted into the holster 10 via the same path by which it is ejected from the holster 10, i.e., into the bottom opening of the holster 10, through the slots 66 on the lower edges of the side plates 30 and 32, and thence, forwardly into the holster 10. This enables the gun 1 to be inserted into the holster 10 in two ways, i.e., through the rear of the holster 10 or through the bottom of the holster 10, as above.

Accordingly, a method embodiment for using the holster 10 of the present invention can comprise the steps of first coupling the adapter 12 to the gun 1, and then inserting the gun 1 and adapter 12 into the holster 10 such that the lands 16 of the adapter 12 are slidably received in corresponding ones of the longitudinal grooves 36 of the side plates 30 and 32 and the latching pawl 38 is engaged with a notch 18 in one of the lands 16 of the adapter 12.

As discussed above, the step of inserting the gun 1 and adapter 12 can comprise either 1) inserting the gun 1 and adapter 13 into a rear end of the holster 10 such that respective ones of front ends of the lands 16 of the adapter 12 enter into corresponding ones of rear ends of the longitudinal grooves 36 of the side plates 30 and 32, or alternatively, 2) inserting the gun land adapter 13 into the bottom end of the holster 10 such that respective ones of front portions of the lands 16 of the adapter 12 pass through corresponding ones of the slots 66 of the side plates 30 and 32 and until an upper surface of each land 16 is in abutment with an upper surface of a corresponding one of the longitudinal grooves 36, and then sliding the gun 1 and adapter 12 forwardly in the grooves 36.

As illustrated in, e.g., FIG. 4E, as an aid to inserting the gun 1 and adapter 12 into the rear end of the holster 10 (or the "top" end thereof if the holster 10 is being worn upright on the wearer's hip), the medial and distal side plates 30 and 32 can be provided with inwardly sloping surfaces 80 on respective ones of the rear ends thereof, and the top or spacer plate 34 can include an elongated slot 82 having an enlarged entryway 84 extending forwardly in a lower surface thereof, the slot 82 and entryway 84 being adapted to receive a blade sight 5 (see FIGS. 8A, 8B) disposed on a front end of an upper surface of the slide 6 of the gun 1 in a slide in engagement.

As discussed above, embodiments of the holster 10 of the present invention can be used with a wide variety of handgun types. For example, FIG. 9 illustrates an alternative embodiment of a holster adapter 86, shown coupled to a lower surface of a front end portion of the receiver of another type of handgun 7, viz., a Colt M1911 pistol. As may be seen in the various elevation and plan views of the alternative adapter 86 in FIGS. 10A-10E, the adapter 86 can incorporate several of the features of the adapter 12 of FIGS. 3A-3E, such as the accessory mounting rail 28 and longitudinal lands 16 of the latter, as well as some additional features not found on the adapter 12, such as a positioning and mounting cup 88 disposed at the rear of the adapter 86 that is configured to enable the adapter to mount to the front surface of the trigger guard of the gun 7.

FIGS. 11A and 11B are right side and rear end elevation view of an example embodiment of a holster 10 in accordance with the present invention, showing the holster 10 coupled to the belt 9 of a wearer and carrying an associated handgun 1 having an accessory, viz., a laser sighting device 8, mounted thereon. As illustrated in these figures, the holster can include a belt loop structure 90 coupled to a proximal side of the holster 10, e.g., to the rear-proximal side cover plate 56, to enable the holster 10 to be worn on a belt 9.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A holster, comprising:

an adapter configured to be coupled to a lower surface of a front end portion of a gun;

a housing having an internal cavity defined by a pair of generally parallel side walls held in spaced opposition to each other by a spacer wall;

complementary sliding features respectively disposed on the adapter and interior surfaces of the side walls and engagable with each other so as to enable the adapter to be slidably received in the cavity of the housing;

complementary latching features respectively disposed on the adapter and interior surfaces of the side walls and engagable with each other so as to prevent the withdrawal of the adapter from the cavity of the housing until selectably released therefrom;

a mechanism for selectably releasing the engagement of the latching features with each other so as to enable the withdrawal of the adapter from the cavity of the housing; and an ejector mechanism for ejecting the gun from the holster in a direction generally perpendicular to a long direction of the gun as the gun is pulled rearwardly from the holster.

2. The holster of claim 1, wherein the complementary sliding features comprise at least one longitudinally extending land disposed on the adapter and at least one complementary longitudinal groove disposed in an interior wall of a side wall.

3. The holster of claim 1, wherein the complementary latching features comprise at least one ratchet disposed on the adapter and at least one complementary pawl disposed on an interior surface of a side wall, the ratchet and pawl being interoperable with each other so as to permit the adapter to be slid into the housing and to prevent the adapter from being slid out of the housing until the pawl is selectably released from the ratchet.

4. The holster of claim 3, wherein the mechanism for selectably releasing the latching features comprises a thumb actuated push button interconnected with the pawl in such a way that pushing the button causes the pawl to disengage from the ratchet.

5. The holster of claim 1, further comprising a mechanism for coupling an accessory to the adapter such that the accessory is disposed outside of the housing when the adapter is slidably received in the cavity of the housing.

6. A holster, comprising:

an adapter configured to be coupled to a lower surface of a front end portion of a gun's receiver, the adapter having opposing side walls, each having one of a pair of forwardly extending longitudinal lands disposed thereon, each land having a notch disposed in a lateral edge thereof;

a housing having a pair of side walls held in spaced opposition by a spacer wall coupled between corresponding upper edges thereof, each side wall having an interior surface containing one of a pair of forwardly extending longitudinal grooves disposed therein, each groove being configured to receive a corresponding one of the lands of the adapter in a slide-in engagement;

a latching mechanism configured to engage at least one of the notches in the lands of the adapter so as to prevent the withdrawal of the adapter from the housing until it is selectably released therefrom;

a release mechanism configured to selectably release the engagement of the latching mechanism with the at least one notch so as to enable the withdrawal of the adapter from the housing; and an ejector mechanism configured to eject the gun from the holster in a direction generally perpendicular to the longitudinal grooves as the gun is pulled rearwardly from the holster.

7. The holster of claim 6, wherein:

the latching mechanism comprises an elongated pawl pivotally disposed within a recess in one of the side walls of the housing and aligned with the longitudinal groove therein;

the pawl has a front end resiliently biased into the groove, an opposite rear end, and a ramp disposed on a lateral surface thereof; and the ramp is configured to engage a front end of a corresponding one of the lands of the adapter and to pivot the front end of the pawl out of the groove when the corresponding land is slid forwardly into the groove.

8. The holster of claim 7, wherein the release mechanism comprises:

a push rod slidably disposed in the side wall for fore and aft movement behind the pawl, the push rod having a front end with a chamfer disposed thereon, the chamfer being configured to pivot the front end of the pawl out of the groove when pushed into engagement with a complementary chamfer disposed on the rear end of the pawl; and a thumb actuated push button slidably disposed on the first side wall for fore and aft movement behind the push rod, the push button having a forwardly protruding boss with a front end disposed behind the push rod, the front end being configured to engage a rear end of the push rod and to urge the push rod forward when the push button is pressed.

9. The holster of claim 6, wherein:

each of the side walls includes a slot extending between a lower edge of the side wall and the longitudinal groove therein;

an elongated ejector cam is pivotally disposed within a recess in one of the side walls of the housing and aligned with the longitudinal groove therein;

the ejector cam has a front end resiliently biased into the groove;

the front end of the cam includes first and second ramps respectively disposed on upper and lower surfaces thereof;

the first ramp is configured to engage a front end of a corresponding one of the lands of the adapter and to pivot the front end of the ejector cam out of the groove when the corresponding land is slid forwardly into the groove; and the second ramp is configured to engage a rear edge of the notch of the corresponding land and to eject the adapter through the slots of the side walls and in a direction generally perpendicular to the longitudinal grooves when the land is slid rearwardly from the groove.

10. The holster of claim 9, wherein the ejector cam comprises a thermoplastic.

11. The holster of claim 10, wherein the thermoplastic comprises polyoxymethylene.

12. The holster of claim 6, wherein the adapter includes a pair of longitudinal grooves defining an accessory mounting rail on a lower surface thereof.

13. The holster of claim 6, further comprising a push button cover shroud coupled to the housing and configured to cover at least two sides of the push button.

14. The holster of claim 6, further comprising a distal cover plate coupled to a distal side of a distal one of the side walls, the cover plate having an extension configured to cover a trigger and/or a trigger guard of the gun when the gun is disposed in the holster.

15. The holster of claim 6, further comprising a belt loop structure coupled to a proximal side of a proximal one of the side walls, the belt loop structure being configured to enable the holster to be worn on a belt of a user.

16. The holster of claim 6, wherein the spacer wall includes an elongated slot extending forwardly in a lower surface thereof, the slot being adapted to receive a blade sight disposed on a front end of an upper surface of the slide of the gun in a slide in engagement.

17. The holster of claim 6, further comprising a stop configured to prevent the adapter from sliding past a front end of the housing.

18. A method for using the holster of claim 9, the method comprising:

coupling the adapter to the gun; and inserting the gun and adapter into the housing such that the lands of the adapter are slidably received in corresponding ones of the longitudinal grooves of the housing and the latching mechanism is engaged with the at least one notch.

19. The method of claim 18, wherein the inserting comprises inserting the gun and adapter into a rear end of the housing such that respective ones of front ends of the lands of the adapter enter into corresponding ones of rear ends of the longitudinal grooves of the side walls.

20. The method of claim 18, wherein the inserting comprises:

inserting the gun and adapter into a bottom end of the housing such that respective ones of front portions of the lands of the adapter pass through corresponding ones of the slots of the side walls and until an upper surface of each land is in abutment with an upper surface of a corresponding one of the longitudinal grooves; and then sliding the gun and adapter forward in the housing.

21. A gun holster, comprising:

a housing having a pair of side walls held in spaced opposition by a spacer wall coupled between corresponding upper edges thereof, each side wall having an inner surface including a groove configured to receive a land of a gun adapter on a gun;

a latching mechanism configured to engage a notch in one of the lands of the adapter; and at least one ejector cam disposed within one of the grooves, the ejector cam being configured to engage a rear edge of the notch to eject the gun from the holster in a direction generally perpendicular to a longitudinal axis of the grooves as the gun is pulled rearwardly from the holster.

* * * * *